US009121615B2

(12) United States Patent
Holtmann et al.

(10) Patent No.: US 9,121,615 B2
(45) Date of Patent: Sep. 1, 2015

(54) COOKING SURFACE FOR INSTALLATION INTO THE WORKING SURFACE OF A KITCHEN CONSOLE

(75) Inventors: Frank Holtmann, Hiddenhausen (DE); Stefan Homburg, Buende (DE); Joerg Vollgraf, Buende (DE)

(73) Assignee: MIELE & CIE. KG., Guetersloh (DE)

( * ) Notice: Subject to any disclaimer, the term of this patent is extended or adjusted under 35 U.S.C. 154(b) by 1863 days.

(21) Appl. No.: 11/017,617

(22) Filed: Dec. 20, 2004

(65) Prior Publication Data

US 2005/0133020 A1 Jun. 23, 2005

(30) Foreign Application Priority Data

Dec. 19, 2003 (DE) ..... 103 60 593

(51) Int. Cl.
*H05B 3/68* (2006.01)
*F24C 15/10* (2006.01)

(52) U.S. Cl.
CPC ..... *F24C 15/102* (2013.01); *F24C 15/108* (2013.01)

(58) Field of Classification Search
USPC ..... 219/443.1, 449.1, 450.1, 452.11, 460.1, 219/461.1, 465.1, 466.1, 468.1, 468.2; 359/350, 359, 360, 361
See application file for complete search history.

(56) References Cited

U.S. PATENT DOCUMENTS

| | | | | | |
|---|---|---|---|---|---|
| 2,914,989 | A | * | 12/1959 | Gretener | 359/360 |
| 3,622,754 | A | * | 11/1971 | Hurko | 219/448.17 |
| 3,686,477 | A | * | 8/1972 | Dills et al. | 219/455.12 |
| 3,745,325 | A | * | 7/1973 | Harvey | 362/6 |
| 3,958,080 | A | * | 5/1976 | Schadler | 348/84 |
| 5,422,460 | A | * | 6/1995 | Bralia et al. | 219/452.12 |
| 6,065,840 | A | * | 5/2000 | Caskey et al. | 359/603 |
| 6,313,447 | B1 | | 11/2001 | Steiner et al. | |

FOREIGN PATENT DOCUMENTS

| | | | | |
|---|---|---|---|---|
| DE | 2729929 | | 1/1979 | |
| DE | 31 44 987 | C2 | 1/1983 | F24C 15/10 |
| DE | 8436740 | U1 | 9/1985 | |
| DE | 40 04 093 | A1 | 8/1991 | A47B 77/08 |
| DE | 19854230 | | 5/2000 | |
| EP | 0180458 | B1 | 1/1990 | F24C 15/00 |
| EP | 0200100 | B1 | 11/1994 | F24C 7/06 |

OTHER PUBLICATIONS

European Search Report, Application Serial No. EP 1 544 548, dated Apr. 4, 2008 (with translation).

* cited by examiner

*Primary Examiner* — Sang Y Paik
(74) *Attorney, Agent, or Firm* — Leydig, Voit & Mayer, Ltd.

(57) ABSTRACT

A cooking surface of box-like structure for installation in the work surface of a kitchen console provided with a lower component having an outwardly facing surface providing for a degree of radiant heat emission in excess of 5, preferably from 0.9 to 0.95, and an inwardly facing surface providing for a degree of radiant heat reflection in excess of 0.5, preferably between 0.9 and 0.95.

11 Claims, 1 Drawing Sheet

COOKING SURFACE FOR INSTALLATION INTO THE WORKING SURFACE OF A KITCHEN CONSOLE

BACKGROUND OF THE INVENTION

1. Field of the Invention

Figure 1:
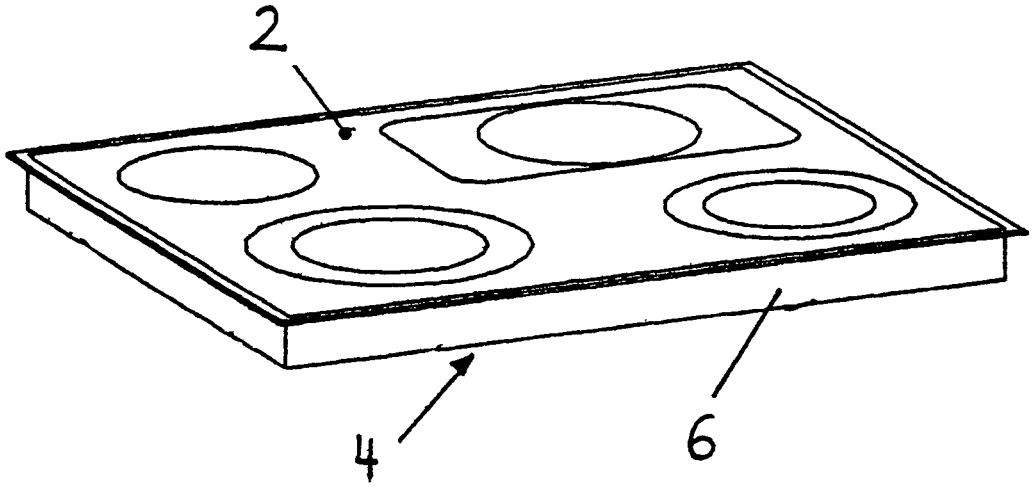

The invention, in general, relates to a cooking surface for installation into the working surface of a kitchen console or the like and, more particularly, to a cooking surface of a substantially box-like structure provided with an upper surface for receiving a cooking utensil, a lower surface for sealing the cooking surface in its installed state in a downward direction, a frame structure for circumferentially sealing the cooking surface, a heating device associated with the cooking surface and means for controlling the heating device.

2. The Prior Art

Such cooking surfaces are well known and are readily available from various sources. The known cooking surfaces are usually of box-like construction and include an upper component upon which a cooking utensil may be placed and lower and lateral components which in the installed state of the cooking surface shield it in downward and lateral directions. Such cooking surfaces are also provided with a source of heat, usually and electric coil and sometimes gas jets as well as with controls for varying the temperature of the cooking surface. In order to reduce the thermal load on the components mounted in the interior of the cooking field, such as, for instance, electrical controls, some of the known cooking fields are provided with a cooling fan. In other cooking surfaces the space between their upper and lower components is kept as large as possible. Moreover, when installed in a console the known cooking surfaces require means, usually made of wood, positioned below their lower components for preventing direct contact with the cooking surface and for protection of the console from the emitted heat.

OBJECTS OF THE INVENTION

It is a general object of the invention to provide a cooking surface of the kind referred to in which the space between the upper and lower components is reduced.

A more specific object of the invention is to reduce the space between upper and lower components of a cooking surface without requiring a cooling fan.

Yet another object of the invention resides in structuring the lower component such its heat emission exceeds a predetermined minimum value.

Still further, it is an object of the invention to provide for controlled heat emission of the outer surface of the lower component either by surface texturing or surface coating.

Other objects will in part be obvious and will in part appear hereinafter.

SUMMARY OF THE INVENTION

These and other objects of the invention are accomplished, in a currently preferred embodiment of the invention, by structuring the outer surface of the lower component such that its degree of outward heat emission is at least 0.5.

Preferably, the structure is achieved by specific roughening of the outer surface or by coating it.

The advantages to be derived from the invention are, among others, that not only can the space between the upper and lower components of the cooking surface be reduced without the need for convective cooling by way of a fan, but that, also, the intermediate bottom beneath the lower component can be dispensed with since in view of the improved heat dissipation from the bottom component to the layer of air below it the temperature of the outwardly facing surface of the lower component is significantly reduced. Since the intermediate bottom is no longer necessary, in situ installation of the unit is rendered less complex.

In a particularly advantageous embodiment of the invention, the value of the degree of emission of radiant heat from the outwardly facing surface of the lower component is in excess of 0.9, preferably more than 0.95. In this manner, the dissipation of heat from the lower component of the installed cooking surface into the layer of air therebelow is further improved.

Another advantageous embodiment provides for coating of the outer surface of the lower component with a black, mat and rough laquer. Lacquers are inexpensive and easily handled. Hence, a coating of a high degree of emission can be easily provided.

Yet another advantageous embodiment of the invention provides for at least partially treating and/or coating the internal surface of the lower component such that the value of the degree of reflection of radiant heat of the internally facing surface of the lower component is in excess of 0.5. In this manner, only a small amount of heat is transmitted from the interior of the cooking surface to the lower component.

DESCRIPTION OF THE SEVERAL DRAWINGS

Figure 2:
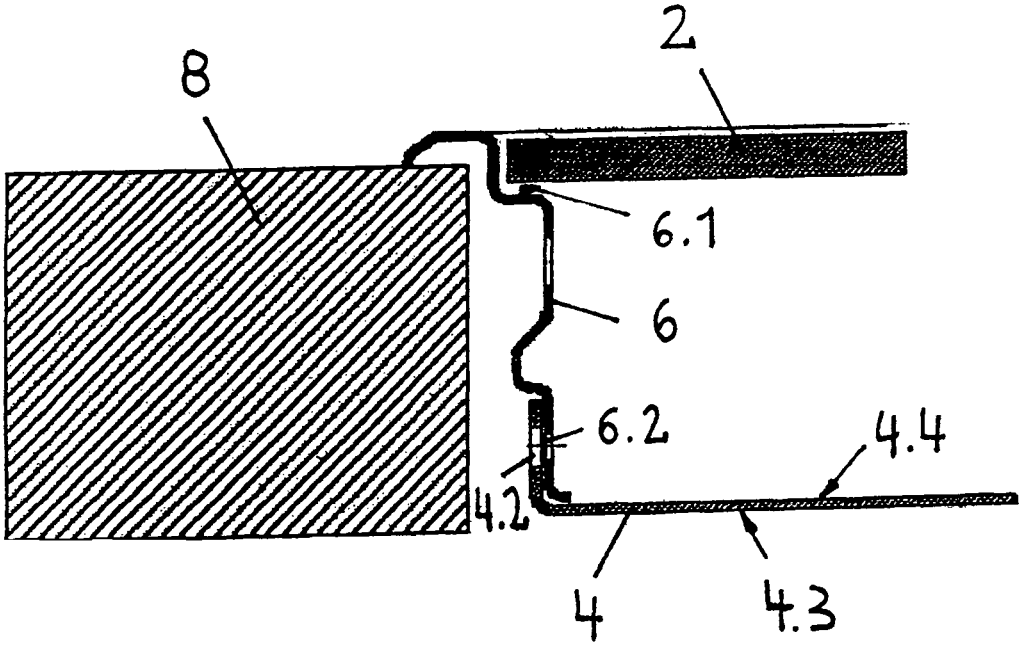

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

FIG. 1 is a perspective view of a cooking surface in accordance with the invention; and FIG. 2 is a partial side view of the cooking surface of FIG. 1 in its installed state, in a sectional presentation.

DETAILED DESCRIPTION OF THE PREFERRED EMBODIMENTS

FIG. 1 depicts a cooking surface for installation into a working surface of a kitchen console (not shown). The cooking surface in accordance with the invention is of box-like construction and is provided with an upper component 2 structured as a glass ceramic plate for receiving a cooking utensil (also not shown), a lower component 4 made of a sheet of stainless steel which serves to close the box-like cooking surface, when installed, in a downward direction, and a frame component 6 of aluminum for laterally closing the cooking surface. The cooking surface is also provided with a heating device and a control unit for the heating device, neither of which have been shown.

FIG. 2 shows the cooking surface in accordance with the invention in its installed position. As is well known to persons skilled in the art, the cooking surface, when installed, is placed into a cut-out in a work surface 8 to which it is then attached. In the present embodiment the upper component 2 is supported by a shoulder 6.1 of a surrounding frame component 6 and is adhesively affixed to the frame 6. The lower component 6 and the frame 6 are each provided with a plurality of openings 4.2 and 6.2 where they are releasably connected to each other by threaded fasteners or the like (not shown).

In the present embodiment the outwardly facing surface 4.3 of the lower component 4 is coated such that the value of the degree of emission of radiant heat of the outwardly directed side of the lower component 4 is in excess of 0.5. This was accomplished by a black, mat and rough laquer (not shown in the drawings) applied to the surface 4.3. It will be understood by those skilled in the art that the coating or laquer, as the case may be, may vary widely in terms of type and applied thickness. Alternatively, the surface 4.3 of the lower component 4 may be at least partially roughened, or that in addition to being coated, the, surface may be roughened.

The mentioned treatment or coating of the outwardly facing surface 4.3 of the lower component is usually sufficient for reducing the temperature in the interior of the inventive cooking surface to the extent that the spacing between the upper component 2 and the lower component 4 of the cooking surface without requiring convective cooling as, for instance by a fan. Moreover, the temperature at the surface 4.3 is reduced such that an intermediate bottom (not shown) disposed beneath the lower component 4 is no longer necessary.

In order further to improve to mentioned effects the inwardly facing surface 4.4 of the lower component 4 in the present embodiment is structured sufficiently smoothly that the value of reflection of radiant heat of the inwardly facing surface of the lower component 4 is in excess of 0.5. To the extent that reducing the temperature at the surface 4.3 of the lower component 4 is of primary concern and, in an embodiment different from the present one, reduced temperature in the interior of the inventive cooking surface is less important, it is within the ambit of the instant invention further to increase the value of reflection of the surface 4.3 of the lower component 4, in particular to a value exceeding 0.9 and, preferably, 0.95. As has already been said, the lower component 4 is heated less, and the temperature at the surface 4.3 is reduced further.

What is claimed is:

1. A cooking surface for installation in the work surface of a kitchen console, comprising:

an upper component for supporting a cooking utensil;

a lower component comprising an inwardly and an outwardly facing surface for sealing the cooking surface in a downward direction;

a frame component for substantially enclosing the cooking surface in a circumferential direction;

means for providing a degree of radiant heat reflection of the inwardly facing surface in excess of 0.5; and means for providing a radiant heat emission value of the outwardly facing surface in excess of 0.5 including a roughening of the surface.

2. The, cooking surface of claim 1, further comprising a source of heat operatively connected with the cooking surface.

3. The cooking surface of claim 2, further comprising means for controlling the source of heat.

4. The cooking surface of claim 1, wherein the heat emission value is greater than 0.9.

5. The cooking surface of claim 4, wherein the heat emission value is greater than 0.95.

6. The cooking surface of claim 1, wherein the means for providing the radiant heat emission value comprises a coating of lacquer.

7. The cooking surface of claim 6, wherein the lacquer is black.

8. The cooking surface of claim 7, wherein the lacquer is mat.

9. The cooking surface of claim 1, wherein the degree of reflection is at least 0.9.

10. The cooking surface of claim 9, wherein the degree of reflection is at least 0.95.

11. The cooking surface of claim 1, wherein the means for providing the radiant heat deflection comprises the surface being smoothly structured.

* * * * *